US010684053B2

(12) United States Patent
Walser

(10) Patent No.: US 10,684,053 B2
(45) **Date of Patent: *Jun. 16, 2020**

(54) VAPOR COMPRESSION SYSTEM WITH COMPRESSOR CONTROL BASED ON TEMPERATURE AND HUMIDITY FEEDBACK

(71) Applicant: Johnson Controls Technology Company, Auburn Hills, MI (US)

(72) Inventor: Jay C. Walser, Norman, OK (US)

(73) Assignee: Johnson Controls Technology Company, Auburn Hills, MI (US)

( * ) Notice: Subject to any disclaimer, the term of this patent is extended or adjusted under 35 U.S.C. 154(b) by 199 days.

This patent is subject to a terminal disclaimer.

(21) Appl. No.: 15/902,082

(22) Filed: Feb. 22, 2018

(65) Prior Publication Data

US 2019/0226736 A1 Jul. 25, 2019

Related U.S. Application Data

(60) Provisional application No. 62/621,972, filed on Jan. 25, 2018.

(51) Int. Cl.

| | |
|---|---|
| ***F25B 13/00*** | (2006.01) |
| ***F25B 49/02*** | (2006.01) |
| ***F25B 41/04*** | (2006.01) |
| *F24F 3/14* | (2006.01) |
| *F24F 3/153* | (2006.01) |
| *F24F 11/30* | (2018.01) |
| *F24F 11/83* | (2018.01) |

(Continued)

(52) U.S. Cl.

CPC ..... *F25B 49/02* (2013.01); *F25B 13/00* (2013.01); *F25B 41/046* (2013.01); *F24F 3/1405* (2013.01); *F24F 3/153* (2013.01); *F24F 11/30* (2018.01); *F24F 11/83* (2018.01); *F24F 11/85* (2018.01); *F24F 11/86* (2018.01); *F24F 2110/20* (2018.01); *F25B 2600/2501* (2013.01); *F25B 2700/02* (2013.01); *F25B 2700/2104* (2013.01)

(58) Field of Classification Search

CPC ..... F25B 49/02; F25B 41/046; F25B 2600/2501; F25B 2700/02; F25B 2700/2104; F24F 11/30; F24F 11/83; F24F 11/85; F24F 11/86; F24F 2110/20; F24F 3/1405; F24F 3/153

See application file for complete search history.

(56) References Cited

U.S. PATENT DOCUMENTS

| | | | |
|---|---|---|---|
| 7,770,411 | B2 | 8/2010 | Knight et al. |
| 8,397,522 | B2 | 3/2013 | Springer et al. |

(Continued)

*Primary Examiner* — Frantz F Jules
*Assistant Examiner* — Lionel Nouketcha
(74) *Attorney, Agent, or Firm* — Fletcher Yoder P.C.

(57) ABSTRACT

A vapor compression system that includes a controller. The controller includes instructions for switching between first and second modes of operation of the vapor compression system. The controller activates a first compressor and a second compressor of the vapor compression system in the first mode of operation in response to a temperature level and a humidity level exceeding a threshold temperature and a threshold humidity level, respectively. And in the second mode of operation, the controller activates the first compressor in response to only the humidity level exceeding the threshold humidity level.

23 Claims, 9 Drawing Sheets

(51) Int. Cl.

| | |
|---|---|
| *F24F 110/20* | (2018.01) |
| *F24F 11/86* | (2018.01) |
| *F24F 11/85* | (2018.01) |

(56) References Cited

U.S. PATENT DOCUMENTS

| | | | | |
|---|---|---|---|---|
| 9,103,575 | B2 | 8/2015 | Taras et al. | |
| 9,772,124 | B2 | 9/2017 | Wintemute et al. | |
| 2014/0137573 | A1* | 5/2014 | Lin | F25B 49/02 62/56 |
| 2014/0345307 | A1* | 11/2014 | Bagley | F25B 49/02 62/115 |
| 2015/0293505 | A1* | 10/2015 | Acosta Gonzalez | F04D 27/00 700/29 |
| 2015/0370271 | A1* | 12/2015 | Raghunathan | F24F 11/62 700/277 |
| 2016/0187896 | A1* | 6/2016 | Jones | H04L 12/2816 700/276 |
| 2016/0273815 | A1 | 9/2016 | Downie et al. | |
| 2017/0030601 | A1 | 2/2017 | Blanton et al. | |

* cited by examiner

TO

VAPOR COMPRESSION SYSTEM WITH COMPRESSOR CONTROL BASED ON TEMPERATURE AND HUMIDITY FEEDBACK

CROSS-REFERENCE TO RELATED APPLICATION

This application is a Non-Provisional Applications claiming priority to U.S. Provisional Application No. 62/621,972, entitled "DEMAND BASED MODE FOR VAPOR COMPRESSION SYSTEM," filed Jan. 25, 2018, which is hereby incorporated by reference in its entirety for all purposes.

BACKGROUND

The present disclosure relates generally to vapor compression systems.

Heating, ventilation, and air conditioning (HVAC) systems exchange energy between fluids in order to cool and dehumidify an enclosed space, such as a home or office building. Typical HVAC systems have two heat exchangers commonly referred to as an evaporator coil and a condenser coil. The evaporator coil and the condenser coil facilitate heat transfer between air surrounding the coils and a refrigerant pumped by a compressor through the coils. For example, as air passes over the evaporator coil, the air cools as it loses energy to the refrigerant passing through the evaporator coil. In contrast, the condenser facilitates the discharge of heat from the refrigerant to the surrounding air. However, some HVAC systems that include multiple compressors may overcool the enclosed space while attempting to control the temperature and humidity in the enclosed space.

SUMMARY

The present disclosure relates to a vapor compression system. The vapor compression system includes a controller. The controller includes instructions for switching between first and second modes of operation of the vapor compression system. The controller activates a first compressor and a second compressor of the vapor compression system in the first mode of operation in response to a temperature level and a humidity level exceeding a threshold temperature and a threshold humidity level, respectively. And in the second mode of operation, the controller activates the first compressor and not the second compressor in response to the humidity level exceeding the threshold humidity level.

The present disclosure also relates to a vapor compression system that includes a first vapor compression loop with a first compressor, a first evaporator coil, and a reheat coil fluidly coupled to the first evaporator coil. A second vapor compression loop with a second compressor and a second evaporator coil. A temperature sensor that detects a temperature in an enclosed space and transmits a first signal indicative of the temperature. A humidity sensor that detects a humidity level in the enclosed space and transmits a second signal indicative of the humidity level. A controller coupled to the first compressor, the second compressor, the temperature sensor, and the humidity sensor. The controller includes a first mode of operation and a second mode of operation. The controller activates the first compressor and the second compressor in a first mode of operation in response to the temperature and the humidity level exceeding a threshold temperature amount and a threshold humidity level, respectively. And in the second mode of operation, the controller activates the first compressor and not the second compressor in response to the humidity level exceeding the threshold humidity level.

The present disclosure also relates to a method of controlling a vapor compression system. The method includes receiving a first signal from a temperature sensor indicative of a temperature in an enclosed space. The method then receives a second signal from a humidity sensor indicative of a humidity level in the enclosed space. The method compares the temperature to a threshold temperature amount and the humidity level to a threshold humidity level. The method then activates a first mode of operation of the vapor compression system in response to the temperature exceeding a threshold temperature amount, wherein activating the first mode of operation includes activating a first compressor of the vapor compression system and a second compressor of the vapor compression system. The method also includes activating a second mode of operation of the vapor compression system in response to the humidity level exceeding the threshold humidity level and not the temperature exceeding the threshold temperature amount, wherein the second mode of operation includes activating the first compressor and not the second compressor.

DRAWINGS

DETAILED DESCRIPTION

Embodiments of the present disclosure include an HVAC system with a controller that controls multiple compressors of the HVAC system in response to feedback from temperature and humidity sensors. More specifically, the controller enables the HVAC system to operate in different modes of operation in order to respond to different environmental conditions within an enclosed space while also conserving energy. These different modes of operation involve turning compressors on and off depending on the cooling needs and humidity levels in the enclosed space. For example, a user may set a desired temperature of an enclosed space to 72° and a desired humidity level to 40%. However, if the actual temperature of the enclosed space is 72° but the humidity level is 55%, a request to reduce the humidity level may result in over cooling of the enclosed space. That is, the HVAC system may cool the enclosed space to a temperature below 72° while attempting to reduce the humidity level. The HVAC system discussed below includes a controller capable of operating the HVAC system in different modes to independently control the humidity and temperature in an enclosed space while also reducing energy consumption.

Figure 1:
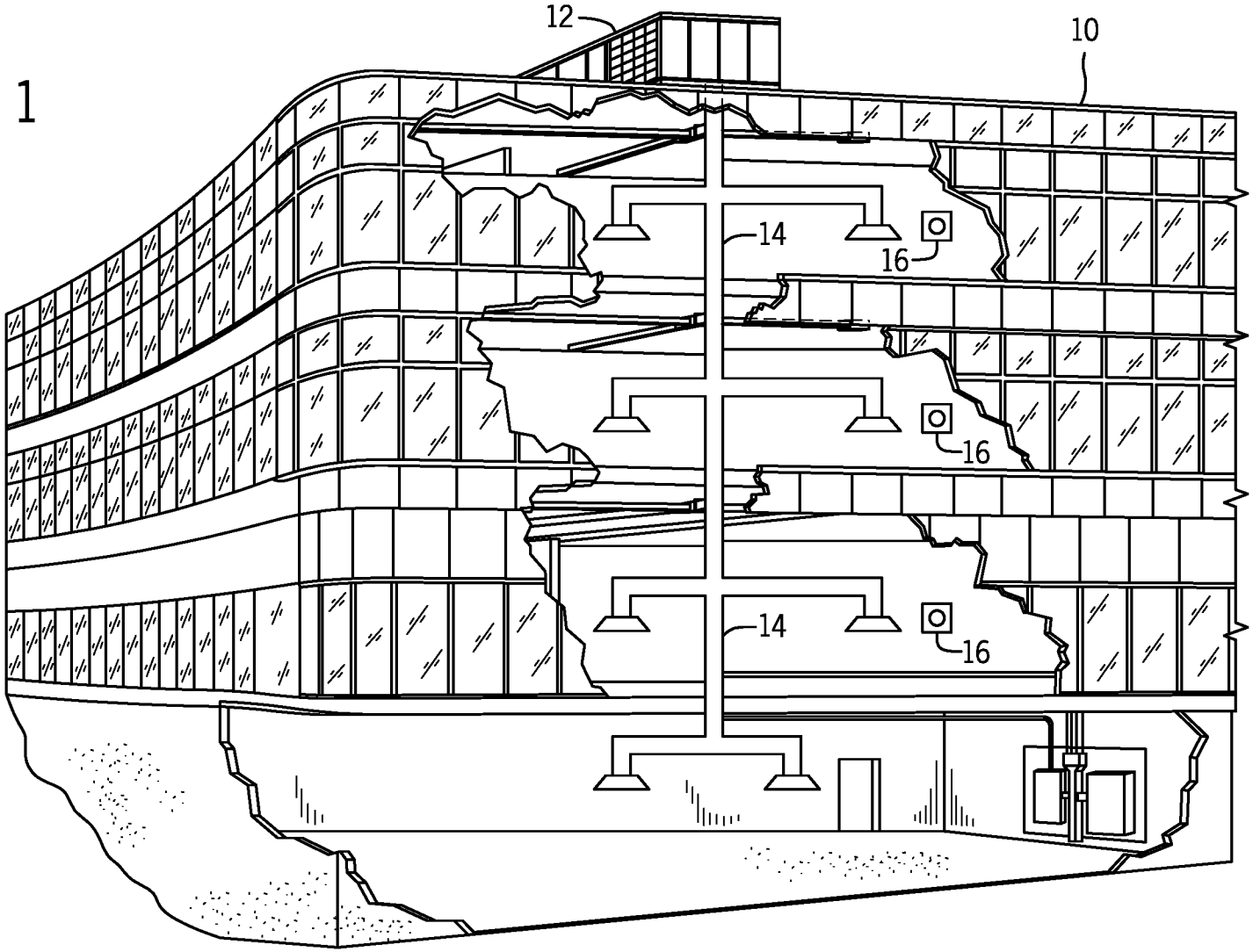
FIG. 1 is a perspective view of an embodiment of a building that may utilize a heating, ventilation, and air conditioning (HVAC) system in a commercial setting, in accordance with an aspect of the present disclosure.

Turning now to the drawings, FIG. 1 illustrates a heating, ventilating, and air conditioning (HVAC) system for building environmental management that may employ one or more HVAC units. In the illustrated embodiment, a building 10 is air conditioned by a system that includes an HVAC unit 12. The building 10 may be a commercial structure or a residential structure. As shown, the HVAC unit 12 is disposed on the roof of the building 10; however, the HVAC unit 12 may be located in other equipment rooms or areas adjacent the building 10. The HVAC unit 12 may be a single package unit containing other equipment, such as a blower, integrated air handler, and/or auxiliary heating unit. In other embodiments, the HVAC unit 12 may be part of a split HVAC system, such as the system shown in FIG. 3, which includes an outdoor HVAC unit 58 and an indoor HVAC unit 56.

The HVAC unit 12 is an air cooled device that implements a refrigeration cycle to provide conditioned air to the building 10. Specifically, the HVAC unit 12 may include one or more heat exchangers across which an air flow is passed to condition the air flow before the air flow is supplied to the building. In the illustrated embodiment, the HVAC unit 12 is a rooftop unit (RTU) that conditions a supply airstream, such as environmental air and/or a return air flow from the building 10. After the HVAC unit 12 conditions the air, the air is supplied to the building 10 via ductwork 14 extending throughout the building 10 from the HVAC unit 12. For example, the ductwork 14 may extend to various individual floors or other sections of the building 10. In certain embodiments, the HVAC unit 12 may be a heat pump that provides both heating and cooling to the building with one refrigeration circuit configured to operate in different modes. In other embodiments, the HVAC unit 12 may include one or more refrigeration circuits for cooling an airstream and a furnace for heating the airstream.

A control device 16, one type of which may be a thermostat, may be used to designate the temperature of the conditioned air. The control device 16 also may be used to control the flow of air through the ductwork 14. For example, the control device 16 may be used to regulate operation of one or more components of the HVAC unit 12 or other components, such as dampers and fans, within the building 10 that may control flow of air through and/or from the ductwork 14. In some embodiments, other devices may be included in the system, such as pressure and/or temperature transducers or switches that sense the temperatures and pressures of the supply air, return air, and so forth. Moreover, the control device 16 may include computer systems that are integrated with or separate from other building control or monitoring systems, and even systems that are remote from the building 10.

Figure 2:
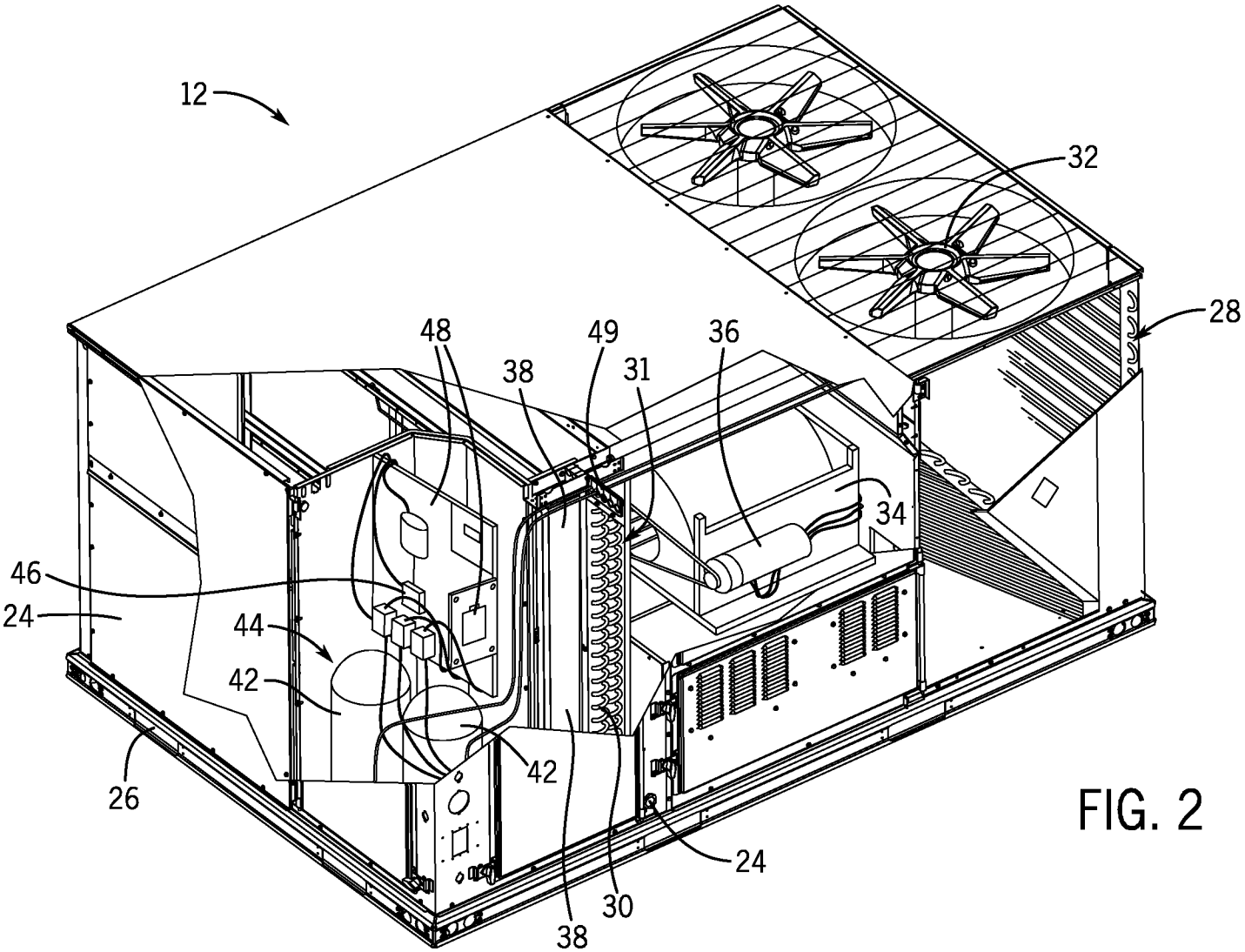
FIG. 2 is a perspective view of an embodiment of an HVAC unit of the HVAC system of FIG. 1, in accordance with an aspect of the present disclosure.

FIG. 2 is a perspective view of an embodiment of the HVAC unit 12. In the illustrated embodiment, the HVAC unit 12 is a single package unit that may include one or more independent refrigeration circuits and components that are tested, charged, wired, piped, and ready for installation. The HVAC unit 12 may provide a variety of heating and/or cooling functions, such as cooling only, heating only, cooling with electric heat, cooling with dehumidification, cooling with gas heat, or cooling with a heat pump. As described above, the HVAC unit 12 may directly cool and/or heat an airstream provided to the building 10 to condition a space in the building 10.

As shown in the illustrated embodiment of FIG. 2, a cabinet 24 encloses the HVAC unit 12 and provides structural support and protection to the internal components from environmental and other contaminants. In some embodiments, the cabinet 24 may be constructed of galvanized steel and insulated with aluminum foil faced insulation. Rails 26 may be joined to the bottom perimeter of the cabinet 24 and provide a foundation for the HVAC unit 12. In certain embodiments, the rails 26 may provide access for a forklift and/or overhead rigging to facilitate installation and/or removal of the HVAC unit 12. In some embodiments, the rails 26 may fit into "curbs" on the roof to enable the HVAC unit 12 to provide air to the ductwork 14 from the bottom of the HVAC unit 12 while blocking elements such as rain from leaking into the building 10.

The HVAC unit 12 includes heat exchangers 28 and 30 in fluid communication with one or more refrigeration circuits. Tubes within the heat exchangers 28 and 30 may circulate refrigerant, such as R-410A, through the heat exchangers 28 and 30. The tubes may be of various types, such as multichannel tubes, conventional copper or aluminum tubing, and so forth. Together, the heat exchangers 28 and 30 may implement a thermal cycle in which the refrigerant undergoes phase changes and/or temperature changes as it flows through the heat exchangers 28 and 30 to produce heated and/or cooled air. For example, the heat exchanger 28 may function as a condenser where heat is released from the refrigerant to ambient air, and the heat exchanger 30 may function as an evaporator where the refrigerant absorbs heat to cool an airstream. In other embodiments, the HVAC unit 12 may operate in a heat pump mode where the roles of the heat exchangers 28 and 30 may be reversed. That is, the heat exchanger 28 may function as an evaporator and the heat exchanger 30 may function as a condenser. In further embodiments, the HVAC unit 12 may include a furnace for heating the airstream that is supplied to the building 10. While the illustrated embodiment of FIG. 2 shows the HVAC unit 12 having two of the heat exchangers 28 and 30, in other embodiments, the HVAC unit 12 may include one heat exchanger or more than two heat exchangers.

The heat exchanger 30 is located within a compartment 31 that separates the heat exchanger 30 from the heat exchanger 28. Fans 32 draw air from the environment through the heat exchanger 28. Air may be heated and/or cooled as the air flows through the heat exchanger 28 before being released back to the environment surrounding the rooftop unit 12. A blower assembly 34, powered by a motor 36, draws air through the heat exchanger 30 to heat or cool the air. The heated or cooled air may be directed to the building 10 by the ductwork 14, which may be connected to the HVAC unit 12. Before flowing through the heat exchanger 30, the conditioned air flows through one or more filters 38 that may remove particulates and contaminants from the air. In certain embodiments, the filters 38 may be disposed on the air intake side of the heat exchanger 30 to prevent contaminants from contacting the heat exchanger 30.

The HVAC unit 12 also may include other equipment for implementing the thermal cycle. Compressors 42 increase the pressure and temperature of the refrigerant before the refrigerant enters the heat exchanger 28. The compressors 42 may be any suitable type of compressors, such as scroll compressors, rotary compressors, screw compressors, or reciprocating compressors. In some embodiments, the compressors 42 may include a pair of hermetic direct drive him arranged in a dual stage configuration 44. However, in other embodiments, any number of the compressors 42 may be provided to achieve various stages of heating and/or cooling. As may be appreciated, additional equipment and devices may be included in the HVAC unit 12, such as a solid-core filter drier, a drain pan, a disconnect switch, an economizer, pressure switches, phase monitors, and humidity sensors, among other things.

The HVAC unit 12 may receive power through a terminal block 46. For example, a high voltage power source may be connected to the terminal block 46 to power the equipment. The operation of the HVAC unit 12 may be governed or regulated by a control board 48. The control board 48 may include control circuitry connected to a thermostat, sensors, and alarms, which may be referred to herein separately or collectively as the control device 16. The control circuitry may be configured to control operation of the equipment, provide alarms, and monitor safety switches. Wiring 49 may connect the control board 48 and the terminal block 46 to the equipment of the HVAC unit 12.

Figure 3:
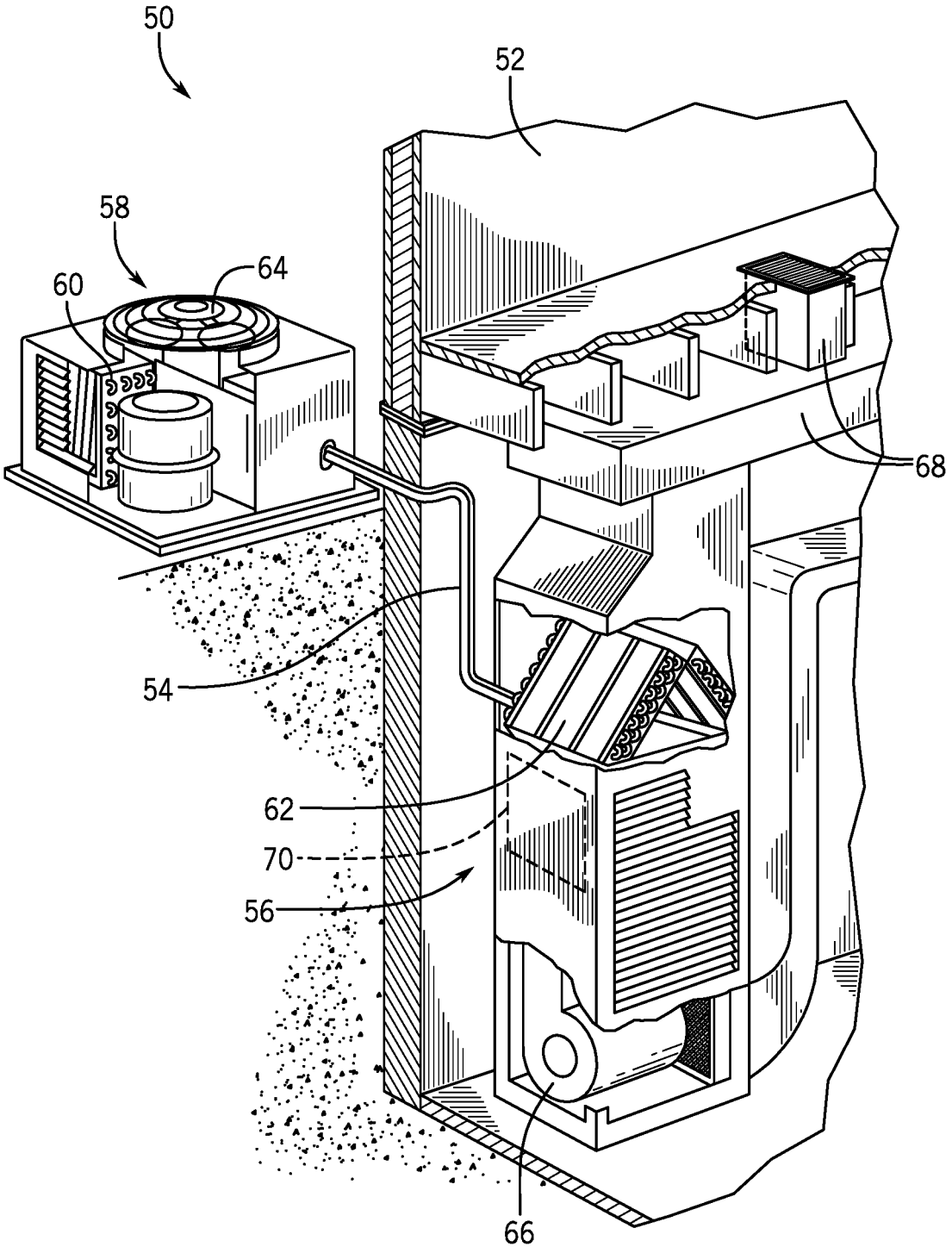
FIG. 3 is a perspective view of an embodiment of a residential, split HVAC system that includes an indoor HVAC unit and an outdoor HVAC unit, in accordance with an aspect of the present disclosure.

FIG. 3 illustrates a residential heating and cooling system 50, also in accordance with present techniques. The residential heating and cooling system 50 may provide heated and cooled air to a residential structure, as well as provide outside air for ventilation and provide improved indoor air quality (IAQ) through devices such as ultraviolet lights and air filters. In the illustrated embodiment, the residential heating and cooling system 50 is a split HVAC system. In general, a residence 52 conditioned by a split HVAC system may include refrigerant conduits 54 that operatively couple the indoor unit 56 to the outdoor unit 58. The indoor unit 56 may be positioned in a utility room, an attic, a basement, and so forth. The outdoor unit 58 is typically situated adjacent to a side of residence 52 and is covered by a shroud to protect the system components and to prevent leaves and other debris or contaminants from entering the unit. The refrigerant conduits 54 transfer refrigerant between the indoor unit 56 and the outdoor unit 58, typically transferring primarily liquid refrigerant in one direction and primarily vaporized refrigerant in an opposite direction.

When the system shown in FIG. 3 is operating as an air conditioner, a heat exchanger 60 in the outdoor unit 58 serves as a condenser for re-condensing vaporized refrigerant flowing from the indoor unit 56 to the outdoor unit 58 via one of the refrigerant conduits 54. In these applications, a heat exchanger 62 of the indoor unit functions as an evaporator. Specifically, the heat exchanger 62 receives liquid refrigerant, which may be expanded by an expansion device, and evaporates the refrigerant before returning it to the outdoor unit 58.

The outdoor unit 58 draws environmental air through the heat exchanger 60 using a fan 64 and expels the air above the outdoor unit 58. When operating as an air conditioner, the air is heated by the heat exchanger 60 within the outdoor unit 58 and exits the unit at a temperature higher than it entered. The indoor unit 56 includes a blower or fan 66 that directs air through or across the indoor heat exchanger 62, where the air is cooled when the system is operating in air conditioning mode. Thereafter, the air is passed through ductwork 68 that directs the air to the residence 52. The overall system operates to maintain a desired temperature as set by a system controller. When the temperature sensed inside the residence 52 is higher than the setpoint on the thermostat, plus a small amount, the residential heating and cooling system 50 may become operative to refrigerate additional air for circulation through the residence 52. When the temperature reaches the setpoint, minus a small amount, the residential heating and cooling system 50 may stop the refrigeration cycle temporarily.

The residential heating and cooling system 50 may also operate as a heat pump. When operating as a heat pump, the roles of heat exchangers 60 and 62 are reversed. That is, the heat exchanger 60 of the outdoor unit 58 will serve as an evaporator to evaporate refrigerant and thereby cool air entering the outdoor unit 58 as the air passes over outdoor the heat exchanger 60. The indoor heat exchanger 62 will receive a stream of air blown over it and will heat the air by condensing the refrigerant.

In some embodiments, the indoor unit 56 may include a furnace system 70. For example, the indoor unit 56 may include the furnace system 70 when the residential heating and cooling system 50 is not configured to operate as a heat pump. The furnace system 70 may include a burner assembly and heat exchanger, among other components, inside the indoor unit 56. Fuel is provided to the burner assembly of the furnace 70 where it is mixed with air and combusted to form combustion products. The combustion products may pass through tubes or piping in a heat exchanger, separate from heat exchanger 62, such that air directed by the blower 66 passes over the tubes or pipes and extracts heat from the combustion products. The heated air may then be routed from the furnace system 70 to the ductwork 68 for heating the residence 52.

Figure 4:
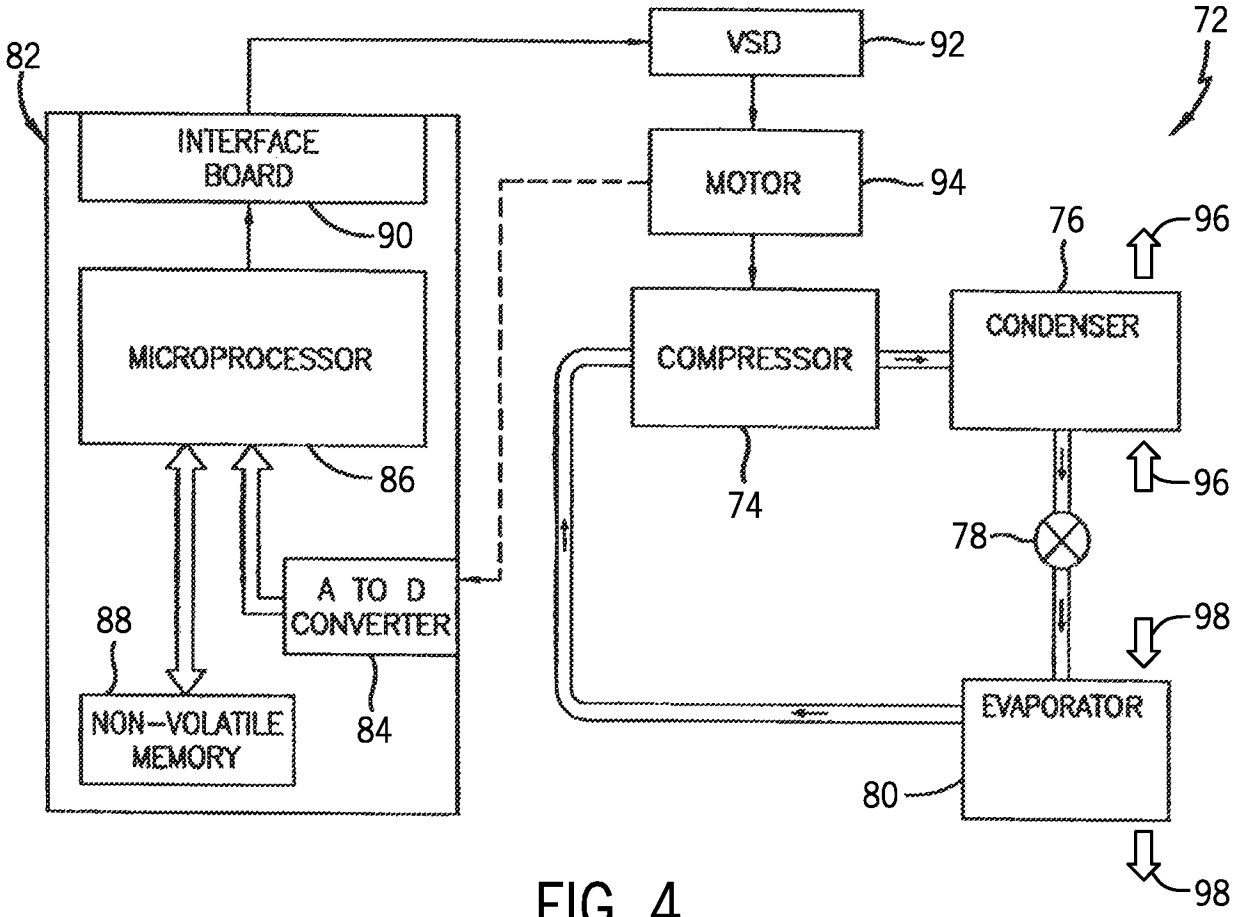
FIG. 4 is a schematic of an embodiment of an HVAC system, in accordance with an aspect of the present disclosure.

FIG. 4 is an embodiment of a vapor compression system 72 that can be used in any of the systems described above. The vapor compression system 72 may circulate a refrigerant through a circuit starting with a compressor 74. The circuit may also include a condenser 76, an expansion valve(s) or device(s) 78, and an evaporator 80. The vapor compression system 72 may further include a control panel 82 that has an analog to digital (A/D) converter 84, a microprocessor 86, a non-volatile memory 88, and/or an interface board 90. The control panel 82 and its components may function to regulate operation of the vapor compression system 72 based on feedback from an operator, from sensors of the vapor compression system 72 that detect operating conditions, and so forth.

In some embodiments, the vapor compression system 72 may use one or more of a variable speed drive (VSDs) 92, a motor 94, the compressor 74, the condenser 76, the expansion valve or device 78, and/or the evaporator 80. The motor 94 may drive the compressor 74 and may be powered by the variable speed drive (VSD) 92. The VSD 92 receives alternating current (AC) power having a particular fixed line voltage and fixed line frequency from an AC power source, and provides power having a variable voltage and frequency to the motor 94. In other embodiments, the motor 94 may be powered directly from an AC or direct current (DC) power source. The motor 94 may include any type of electric motor that can be powered by a VSD or directly from an AC or DC power source, such as a switched reluctance motor, an induction motor, an electronically commutated permanent magnet motor, or another suitable motor.

The compressor 74 compresses a refrigerant vapor and delivers the vapor to the condenser 76 through a discharge passage. In some embodiments, the compressor 74 may be a centrifugal compressor. The refrigerant vapor delivered by the compressor 74 to the condenser 76 may transfer heat to a fluid passing across the condenser 76, such as ambient or environmental air 96. The refrigerant vapor may condense to a refrigerant liquid in the condenser 76 as a result of thermal heat transfer with the environmental air 96. The liquid refrigerant from the condenser 76 may flow through the expansion device 78 to the evaporator 80.

The liquid refrigerant delivered to the evaporator 80 may absorb heat from another airstream, such as a supply airstream 98 provided to the building 10 or the residence 52. For example, the supply airstream 98 may include ambient or environmental air, return air from a building, or a combination of the two. The liquid refrigerant in the evaporator 80 may undergo a phase change from the liquid refrigerant to a refrigerant vapor. In this manner, the evaporator 38 may reduce the temperature of the supply airstream 98 via thermal heat transfer with the refrigerant. Thereafter, the vapor refrigerant exits the evaporator 80 and returns to the compressor 74 by a suction line to complete the cycle.

In some embodiments, the vapor compression system 72 may further include a reheat coil in addition to the evaporator 80. For example, the reheat coil may be positioned downstream of the evaporator relative to the supply airstream 98 and may reheat the supply airstream 98 when the supply airstream 98 is overcooled to remove humidity from the supply airstream 98 before the supply airstream 98 is directed to the building 10 or the residence 52.

It should be appreciated that any of the features described herein may be incorporated with the HVAC unit 12, the residential heating and cooling system 50, or other HVAC systems. Additionally, while the features disclosed herein are described in the context of embodiments that directly heat and cool a supply airstream provided to a building or other load, embodiments of the present disclosure may be applicable to other HVAC systems as well. For example, the features described herein may be applied to mechanical cooling systems, free cooling systems, chiller systems, or other heat pump or refrigeration applications.

Figure 5:
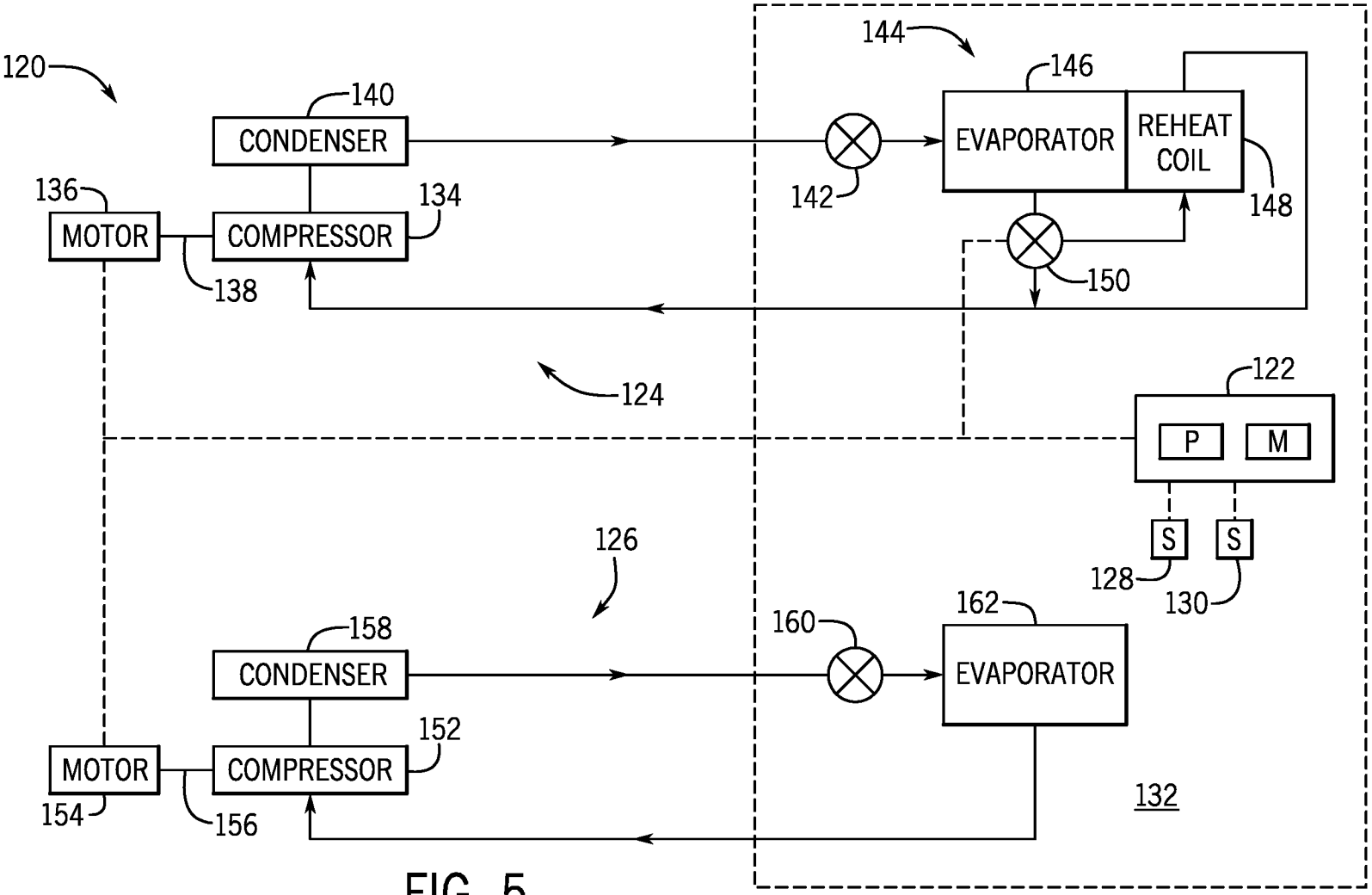
FIG. 5 is a schematic of an embodiment of an HVAC system, in accordance with an aspect of the present disclosure.

FIG. 5 is a schematic of an embodiment of an HVAC system 120. The features of the HVAC system 120 may be incorporated into any of the HVAC systems described above with reference to FIGS. 1-4. The HVAC system 120 includes a controller 122 capable of independently controlling first and second vapor compression loops 124, 126 in response to feedback from a humidity sensor 128 and a temperature sensor 130. That is, the controller 122 enables the HVAC system 120 to operate in different modes of operation when responding to changing environmental conditions within an enclosed space 132. For example, the first vapor compression loop 124 may be a first packaged rooftop unit, and the second vapor compression loop 126 may be a second packaged rooftop unit controlled by the same controller 122.

Responding in different ways to climate control requests may enable the HVAC system 120 to conserve energy by operating one of the vapor compression loops 124, 126 instead of both. For example, a user may set a desired temperature of an enclosed space to 72° and a desired humidity level to 40%. However, if the actual temperature of the enclosed space is 72° but the humidity level is 55%, a request to reduce the humidity level may result in over cooling of the enclosed space. That is, the HVAC system 120 may cool the enclosed space 132 to a temperature below 72° while attempting to reduce the humidity level. The HVAC system 120 discussed below includes the controller 122 with multiple modes of operation that enables independent control of the first and second vapor compression loops 124, 126 when responding to a climate control request.

As illustrated, the first vapor compression loop 124 begins with a compressor 134 that compresses and drives refrigerant using power generated by a motor 136. As illustrated, the motor 136 couples to the compressor 134 with a shaft 138. As the motor 136 rotates the shaft 138, the motor 136 transfers power through the shaft 138 to the compressor 134. The motor 136 may be an electric motor, gas powered motor, diesel motor, or other suitable motor. After passing through the compressor 152, the refrigerant flows to a condenser 140. In the condenser 140, the refrigerant rejects heat, thereby enabling the refrigerant to condense and change from a gaseous to a liquid state. The refrigerant then exits the condenser 140 and flows through the thermal expansion valve 142 (TXV). As refrigerant passes through the thermal exchange valve 142 the pressure of the refrigerant drops rapidly, which in turn causes the refrigerant to rapidly cool. The refrigerant then enters the evaporator system 144. In the evaporator system 144, the changes a temperature of a supply airstream through heat transfer with the refrigerant.

The evaporator system 144 includes an evaporator coil 146 and a reheat coil 148. In operation, the evaporator coil 146 and reheat coil 148 condition the supply airstream by either reducing the humidity of the supply stream or cooling and dehumidifying the supply airstream. The controller 122 controls whether the first vapor compression loop 124 cools and dehumidifies or whether the evaporator system 144 only dehumidifies. The controller 122 transitions the evaporator system 144 from cooling and dehumidifying to just dehumidifying by controlling a valve 150. The valve 150 controls the flow of refrigerant as it exits the evaporator coil 146. For example, if the controller 122 wants to cool and dehumidify, the controller 122 controls the valve 150 to divert hot refrigerant from the evaporator coil 146 directly to the compressor 134 and away from the reheat coil 148. However, the controller 122 may also dehumidify the supply airstream without cooling it by directing the hot refrigerant exiting the evaporator coil 146 into the reheat coil 148. In some embodiments, the valve 150 may be a solenoid valve.

More specifically, as the air supply stream passes through the evaporator coil 146, the cold refrigerant cools and reduces the vapor capacity of the supply airstream. The reduction in vapor capacity causes excess water vapor in the supply airstream to condense out of the supply airstream. The drier and colder air then passes through the reheat coil 148 where it may be warmed by the hot refrigerant exiting the evaporator coil 146. The supply airstream may then exit at approximately the same temperature at which it enters but at a lower humidity when the reheat coil 148 is in operation. Air exiting the reheat coil 148 may be referred to as neutral air or air that has not significantly changed its temperature in the evaporator system 144. After passing through the reheat coil 148, the refrigerant is directed to the compressor 134 where it is again compressed and recycled through the first vapor compression loop 124.

The second vapor compression loop 126 operates in a similar way, but without the ability to reheat the supply airstream. In other words, the second vapor compression loop 126 does not include a reheat coil. The second vapor compression loop 126 begins with a compressor 152 that compresses and drives refrigerant using power generated by a motor 154. As illustrated, the motor 154 couples to the compressor 152 with a shaft 156. As the motor 154 rotates the shaft 138, the motor 154 transfers power through the shaft 138 to the compressor 152. The motor 154 may be an electric motor, gas powered motor, diesel motor, or other suitable motor. After passing through the compressor 152, the refrigerant flows to a condenser 158. In the condenser 158, the refrigerant rejects heat, thereby enabling the refrigerant to condense and change from a gaseous to a liquid state. The refrigerant then exits the condenser 158 and flows through the thermal exchange valve 160 (TXV). As refrigerant passes through the thermal exchange valve 160 the pressure of the refrigerant drops rapidly, which in turn causes the refrigerant to rapidly cool. The refrigerant then enters the evaporator coil 162. In the evaporator coil 162, the cold refrigerant cools and reduces the vapor capacity of the supply airstream. The reduction in vapor capacity causes excess water vapor in the supply airstream to condense out of the supply airstream. The drier and colder supply airstream then exits the second vapor compression loop 126 and enters the enclosed space 132. After passing through the condenser coil 162, the refrigerant is directed to the compressor 152 where it is again compressed and recycled through the second vapor compression loop 126.

Figure 6:
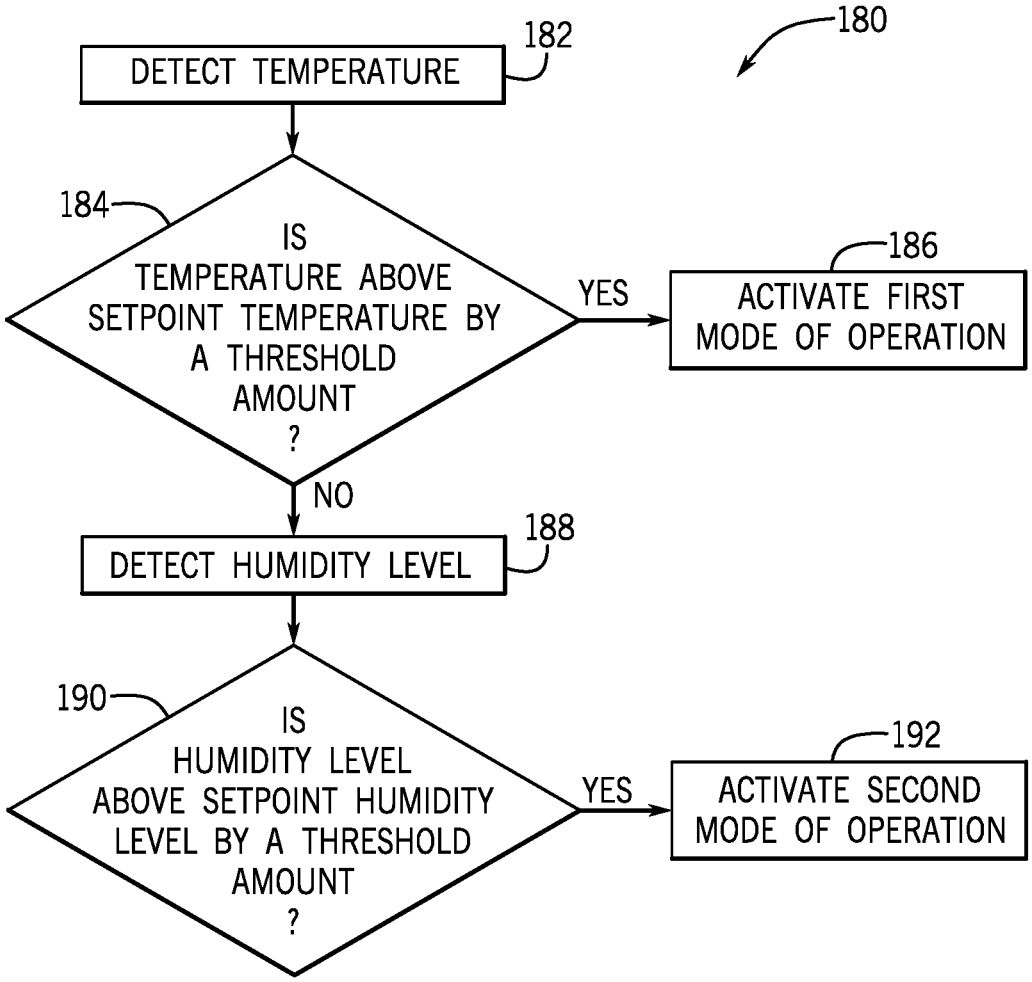
FIG. 6 is a flow chart of a method for controlling operation of the HVAC system in FIG. 5, in accordance with an aspect of the present disclosure.

FIG. 6 is a flow chart of a method 180 for controlling the HVAC system 120 of FIG. 5. More specifically, the method 180 illustrates the ability of the controller 122 to switch the HVAC system 120 between different modes of operation in order conserve energy while controlling the climate of the enclosed space 132. The method 180 begins by detecting the temperature in the enclosed space 132 with the temperature sensor 130, as indicated by block 182. The controller 122 receives a signal from the temperature sensor 130 indicative of the temperature in the enclosed space 132. The controller 122 processes this signal using a processor that executes software stored on a memory to determine whether the temperature sensed by the temperature sensor 130 is above a setpoint temperature by a threshold amount, as indicated by block 184. For example, a user may have selected 74° as the setpoint temperature. If the feedback from the temperature sensor is 77° and the threshold amount programmed into the controller is 2° above the setpoint temperature, the controller 122 recognizes the desire to cool the enclosed space 132. The controller 122 then controls operation of the HVAC system 120 in a first mode of operation, as indicated by block 186. The first mode of operation may also be referred to as an alternate mode of operation. In the first mode of operation, the controller 122 activates both the first and second vapor compression loops 124, 126. That is, the controller 122 activates both motors 136 and 154 to pump refrigerant through the respective first and second vapor compression loops 124, 126. As the refrigerant flows through the first and second vapor compression systems 124, 126, both of the evaporator coils 146, 162 remove humidity from the air, but the first vapor compression loop 124 will produce neutral temperature air by reheating the air with the reheat coil 148 before discharging it into the enclosed space 132. In contrast, the second vapor compression loop 126 will discharge cold air into the enclosed space. In this way, the HVAC system 120 operating in the first mode cools and dehumidifies the supply airstream entering the enclosed space 132.

If the temperature in the enclosed space 132 is not above the setpoint temperature by a threshold amount, the controller 122 continues by detecting the humidity level in the enclosed space, as indicated by block 188. The controller 122 receives a signal from the humidity sensor 128 indicative of the humidity in the enclosed space 132. The controller 122 processes this signal with a processor that executes software stored on a memory to determine whether the humidity level detected by the humidity sensor 128 is above a setpoint humidity level by a threshold amount above the setpoint humidity level, as indicated by block 190. For example, a user may have selected 40% humidity as the setpoint humidity. If the feedback from the humidity sensor 128 is 55% and the threshold amount programmed into the controller 122 is 5% above the setpoint humidity level, the controller 122 recognizes that the detected humidity is greater than the setpoint humidity by the threshold level amount. The controller 122 then switches the HVAC system 120 to a second mode of operation, as indicated by block 192. The second mode of operation may also be referred to as a normal mode of operation. In the second mode of operation, the controller 122 activates the first vapor compression loop 124 but not the second vapor compression loop 126. That is, the controller 122 activates the motor 136 to pump refrigerant through the first vapor compression loop 124. As the refrigerant flows through the first vapor compression loop 124, the evaporator coil 146 dehumidifies and cools the supply airstream after which the reheat coil 148 reheats the air. The supply airstream now enters at a lower humidity level but does not cool the enclosed space 132. In other words, in the second mode of operation, the controller 122 enables the HVAC system 120 to maintain the same temperature in the enclosed space 132 while still dehumidifying the supply airstream.

Figure 7:
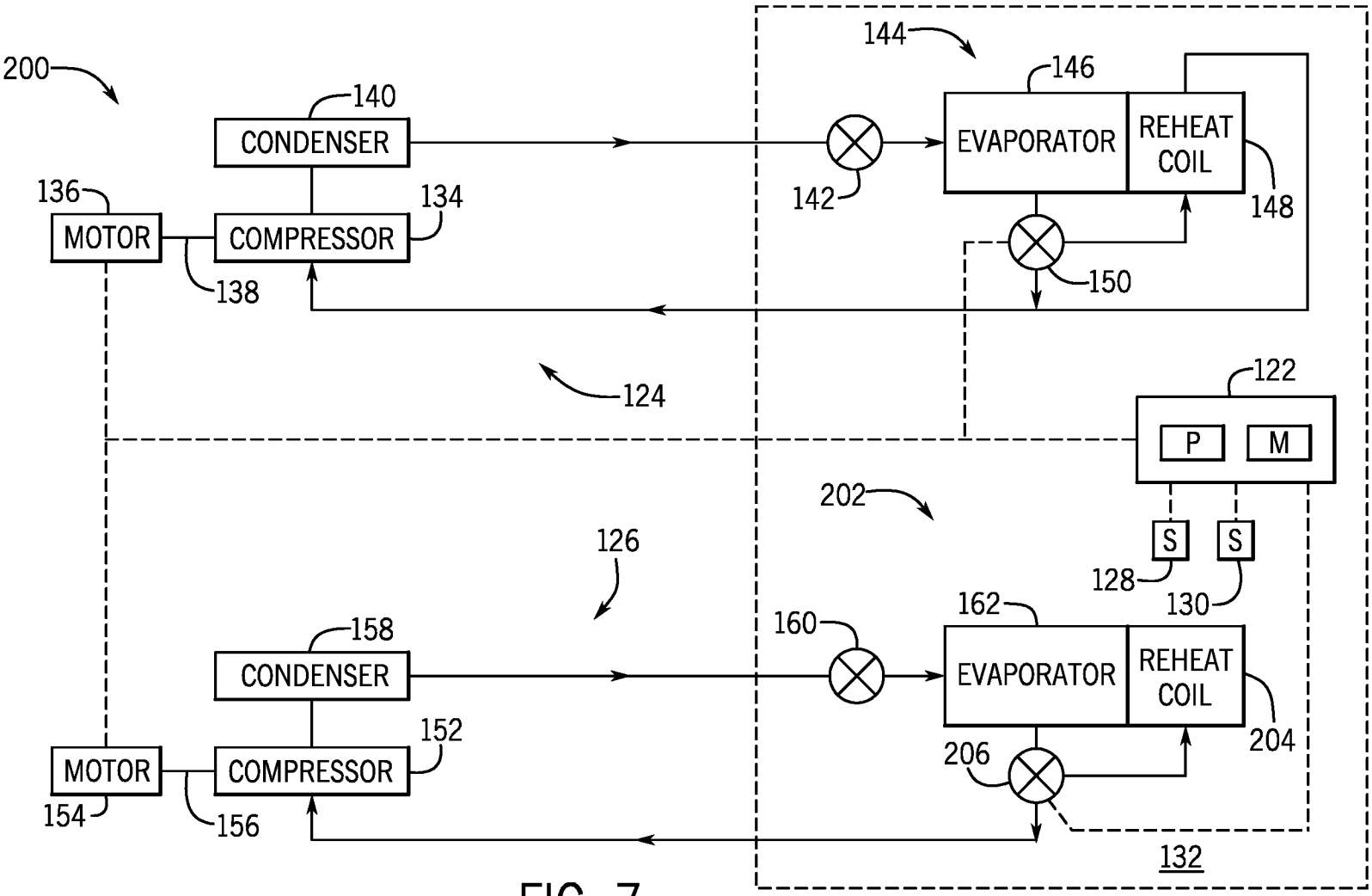
FIG. 7 is a schematic of an embodiment of an HVAC system, in accordance with an aspect of the present disclosure.

FIG. 7 is a schematic of an embodiment of an HVAC system 200, which may be incorporated with any of the HVAC systems described above with reference to FIGS. 1-4. The HVAC system 200 includes a controller 122 capable of independently controlling first and second vapor compression loops 124, 126 in response to a detected humidity level and temperature. The humidity level and temperature are detected by a humidity sensor 128 and a temperature sensor 130. In operation, the controller 122 uses feedback from the humidity sensor 128 and the temperature sensor 130 to operate the HVAC system 200 in different modes in order to customize the response of the HVAC system 200 to different environmental condition in the enclosed space 132. These different modes of operation involve starting and stopping the flow of refrigerant through the respective first and second vapor compression loops 124 and 126 as well as controlling how the refrigerant flows through the first and second vapor compression loops 124, 126.

The first and second vapor compression loops 124, 126 begin with respective compressors 134, 152 that compress and drive refrigerant using power generated by the motors 136, 154. The motors 136, 154 couple to the respective compressors 134, 152 with respective shafts 138, 156. As the motors 136, 154 rotate, the shafts 138, 156 transfer power to the compressors 134, 152. After passing through the compressors 134, 152, the refrigerant flows to the condensers 140, 158. In the condensers 140, 158, the refrigerant rejects heat, thereby enabling the refrigerant to condense and change from a gaseous to a liquid state. The refrigerant then exits the condensers 140, 158 and flows through respective thermal expansion valves 142, 160 (TXV). As refrigerant passes through the thermal exchange valves 142, 160 the pressure of the refrigerant drops rapidly, which in turn causes the refrigerant to rapidly cool. The refrigerant then enters the respective evaporator systems 144, 202.

As illustrated, the evaporator systems 144, 202 include respective evaporator coils 146, 162 and reheat coils 148, 204. In operation, the evaporator coils 146, 162 and reheat coils 148, 204 condition respective supply airstreams by either reducing the humidity of the supply stream or cooling and dehumidifying the supply airstreams. The controller 122 controls whether the evaporator system 144 cools and dehumidifies or whether the evaporator system 144 only dehumidifies by controlling a valve 150. As explained above, the valve 150 may divert refrigerant to or away from the reheat coil 148, as it exists the evaporator coil 146. The controller 122 likewise controls whether the second evaporator system 202 cools and dehumidifies or whether it only dehumidifies. Similar to the valve 150 in the first evaporator system 144, the second evaporator system 202 includes a valve 206 that may divert refrigerant to or away from the reheat coil 204 as it exists the evaporator coil 162. The valves 150 and 206 may be solenoid valves.

For example, if the controller 122 wants to cool and dehumidify the supply airstream with the first vapor compression loop 124, the controller 122 controls the valve 150 to divert hot refrigerant from the evaporator coil 146 directly to the compressor 152. In this way, the hot refrigerant exiting the evaporator coil 146 does not flow through the reheat coil 148. However, the controller 122 may also dehumidify the supply airstream without cooling it by directing the hot refrigerant exiting the evaporator coil 146 into the reheat coil 148. In other words, as the air supply stream passes through the evaporator coil 146, the cold refrigerant cools and reduces the vapor capacity of the supply airstream. The reduction in vapor capacity causes excess water vapor in the supply airstream to condense out of the supply airstream. The drier and colder air then passes through the reheat coil where it is warmed by the hot refrigerant exiting the evaporator coil 146. The supply airstream then exits at approximately the same temperature at which it enters but at a lower humidity. Air produced by this process may be referred to as neutral air. After passing through the reheat coil 148, the refrigerant is directed to the compressor 152 where it is again compressed and recycled through the first vapor compression loop 124.

The controller 122 may likewise control whether the second vapor compression loop 126 cools and dehumidifies or dehumidifies the supply airstream by controlling the valve 206. For example, if the controller 122 wants to cool and dehumidify the supply airstream with the second vapor compression loop 126, the controller 122 controls the valve 206 to divert hot refrigerant from the evaporator coil 162 directly to the compressor 152. In this way, the hot refrigerant exiting the evaporator coil 162 does not flow through the reheat coil 204. However, the controller 122 may also dehumidify the supply airstream without cooling it by directing the hot refrigerant exiting the evaporator coil 162 into the reheat coil 204. After passing through the reheat coil 204 the refrigerant is directed to the compressor 152 where it is again compressed and recycled through the second vapor compression loop 126.

Figures 8A, 8B:
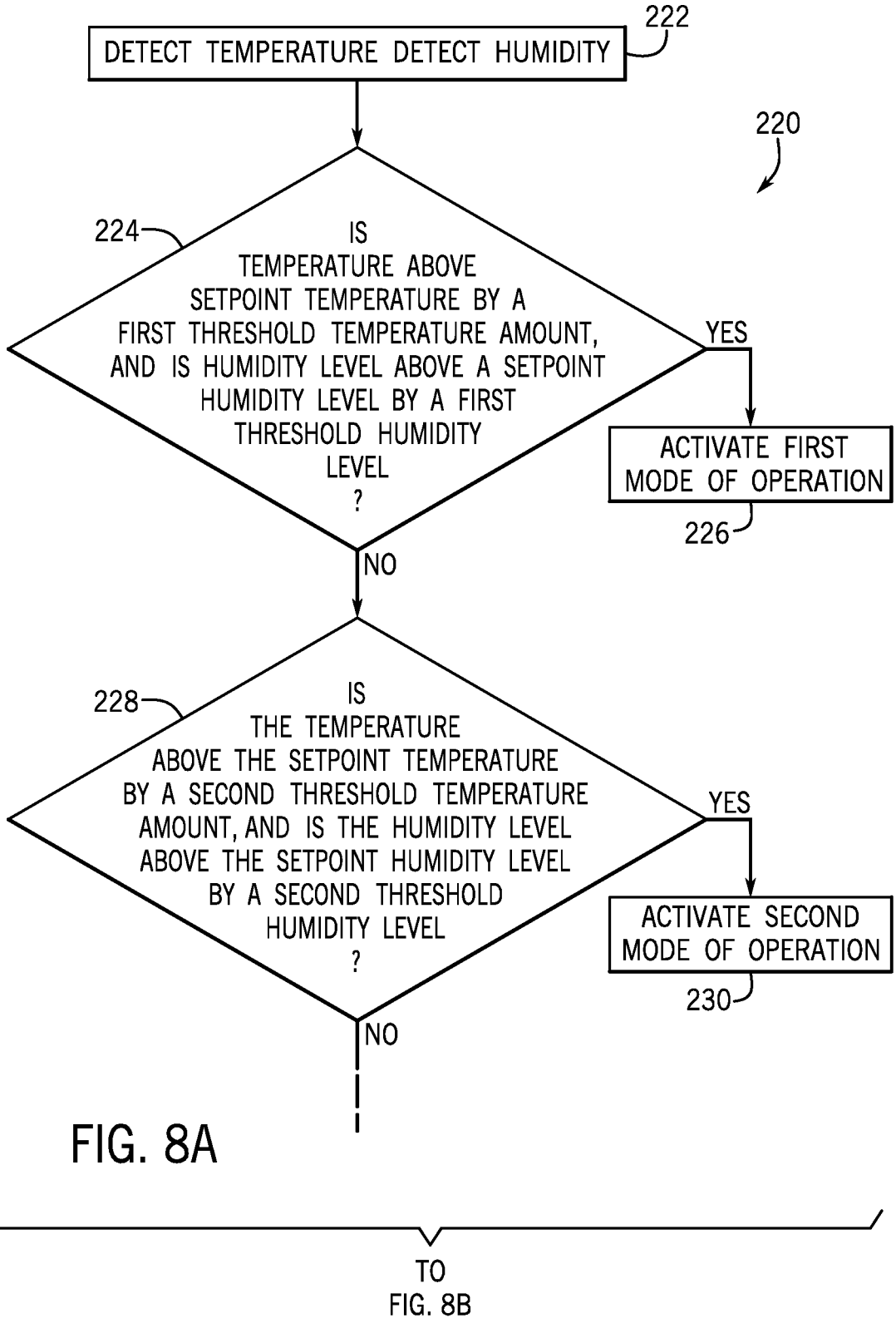
FIGS. 8A and 8B illustrate a flow chart of a method for controlling operation of the HVAC system in FIG. 7, in accordance with an aspect of the present disclosure.
Figure 8B:
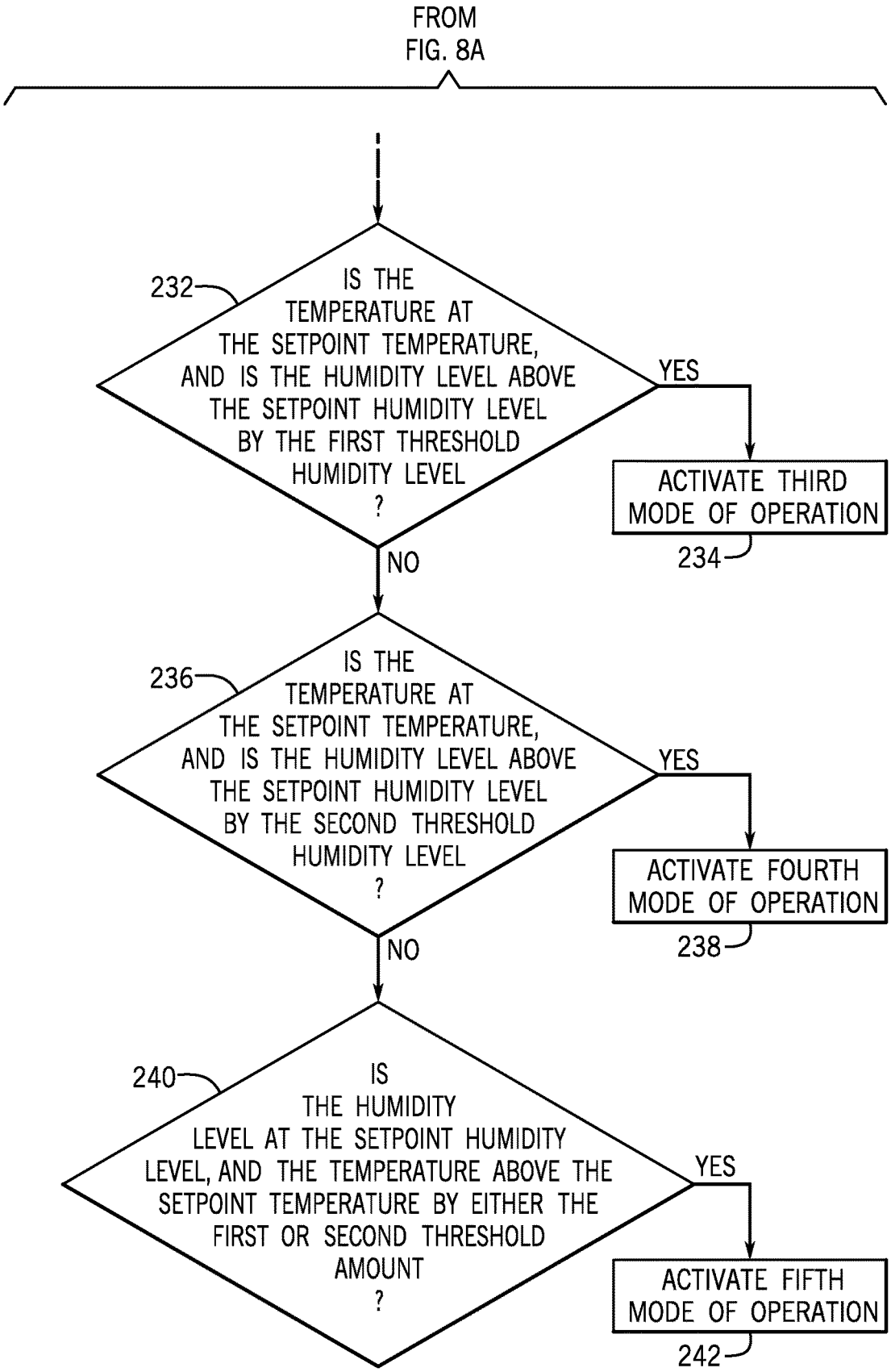

FIGS. 8A and 8B illustrate a flow chart of a method 220 for controlling the HVAC system 200 of FIG. 7. The method 220 illustrates the ability of the controller 122 to switch the HVAC system 200 between different modes of operation in order to conserve energy as well as control the climate within the enclosed space 132. The method 220 begins by detecting the temperate and humidity in the enclosed space 132 with the humidity sensor 128 and temperature sensor 130, as indicated by block 222. The controller 122 executes software stored in a memory with a processor to determine whether the temperature sensed by the temperature sensor 130 is above a setpoint temperature by a first threshold amount and whether the sensed humidity is above the setpoint humidity by a first threshold humidity level, as indicated by block 224. For example, a user may have selected 74° F. as the setpoint temperature and a humidity level of 40%. If feedback from the temperature sensor is 80° F. and the first threshold temperature amount programmed into the controller is 5° F. greater than the setpoint temperature, the controller 122 recognizes that the detected temperature is greater than the setpoint temperature by the first threshold temperature amount. In some embodiments, the first temperature threshold amount may be 2, 3, 4, 5, 6, 7, 8, 9, 10, or more degrees above the setpoint temperature. Likewise, if the detected humidity level is 60% and the first threshold humidity level is 15%, the controller 122 recognizes that the detected humidity is greater than the setpoint humidity level by the first threshold humidity level. In some embodiments, the first threshold humidity level may be 2, 3, 4, 5, 6, 7, 8, 9, 10, or more percent above the setpoint humidity level. If both the temperature and humidity level are above the first threshold amount or level, the controller 122 activates the first mode of operation in which both the first and second vapor compression loops 124 and 126 cool and dehumidify, as indicated by block 226. In other words, the controller 122 controls the valves 150 and 168 so that the refrigerant is directed away from the reheat coils 148 and 204. This enables the HVAC system 120 to rapidly cool and dehumidify the enclosed space 132 using both the first and second vapor compression loops 124, 126.

If neither the temperature nor the humidity level are above the first threshold amount or level, the controller 122 determines whether the temperature is above a second threshold level and whether humidity level is above a second threshold humidity level, as indicated by block 208. For example, a user may have selected 74° F. as the setpoint temperature and a humidity level of 40%. If the feedback from the temperature sensor is 77° F. and the second threshold temperature amount programmed into the controller is 2° F. greater than the setpoint temperature, the controller 122 recognizes that the detected temperature is greater than the setpoint temperature by the second threshold temperature amount. In some embodiments, the second threshold temperature amount may be 0.5, 1, 1.5, 2, 2.5, or more degrees above the setpoint temperature. Likewise, if the detected humidity level is 50% and the second threshold humidity level is 7%, the controller 122 recognizes that the detected humidity is greater than the setpoint humidity level by the second threshold humidity level. In some embodiments, second threshold humidity level may be 2, 3, 4, 5, or more percent above the setpoint humidity level. If both the temperature and humidity level are above the second threshold amount or level, the controller 122 activates the second mode of operation in which the first vapor compression loop 124 cools and dehumidifies and the second vapor compression loop 126 only dehumidifies, block 230. In other words, the controller 122 controls the valve 150 to divert refrigerant away from the reheat coil 148, while simultaneously controlling the valve 168 to divert refrigerant into the reheat coil 204 of the second vapor compression loop 126. This enables the HVAC system 120 to gradually cool the enclosed space 132 without overcooling the enclosed space. In some embodiments, the controller 122 may switch and have the second vapor compression loop 126 cool and dehumidify while the first vapor compression loop 124 dehumidifies.

If the condition in block 228 is not satisfied, the method 220 determines if the temperature is at a setpoint temperature, or in other words below the second threshold temperature amount. If the temperature is at the setpoint temperature, the method 220 then determines whether the humidity level is above the first threshold humidity level, as indicated by block 232. For example, a user may have selected 74° F. as the setpoint temperature and a humidity level of 40%. If the feedback from the temperature sensor is 74° F., the detected humidity level is 60%, and the first threshold humidity level is 15%, the controller 122 recognizes that the detected humidity is greater than the setpoint humidity level by the first threshold humidity level. In some embodiments, the first threshold humidity level may be 2, 3, 4, 5, 6, 7, 8, 9, 10, or more percent above the setpoint humidity level. In response, the controller 122 activates a third mode of operation in which both the first and second vapor compression loops 124 and 126 dehumidify, as indicated by block 234. In other words, the controller 122 controls the valves 150 and 168 so that the refrigerant in the first and second vapor compression loops 124, 126 is directed to the reheat coils 148 and 204. This enables the HVAC system 120 to rapidly dehumidify the enclosed space 132 using both the first and second vapor compression loops 124, 126 without reducing the temperature of the enclosed space 132.

If the condition in block 232 is not satisfied, the method 220 determines if the temperature is at a setpoint temperature, or in other words below the second threshold temperature amount. If the temperature is at the setpoint temperature, the method 220 determines whether the humidity level is above the second threshold humidity level, as indicated by block 236. For example, a user may select 74° F. as the setpoint temperature and a humidity level of 40%. If the feedback from the temperature sensor is 74° F., the detected humidity level is 50%, and the second threshold humidity level is 5% above the setpoint humidity level, the controller 122 recognizes that the detected humidity is greater than the setpoint humidity level by the second threshold humidity level. In some embodiments, the second threshold humidity level may be 2, 3, 4, 5, 6, 7, 8, 9, 10, or more percent above the setpoint humidity level. In response, the controller 122 activates a fourth mode of operation in which the first or second vapor compression loops 124, 126 dehumidifies, as indicated by block 238. In other words, the controller 122 shuts down one of the vapor compression loops 124 or 126 while operating the other with the respective heat coil 148, 204. This enables the HVAC system 120 to gradually dehumidify the enclosed space 132 using one of the vapor compression loops 124, 126.

Finally, if the condition in block 236 is not satisfied, the method 220 determines if the temperature is above the setpoint temperature by either the first or second threshold temperature amount. If the temperature is above either the first or second threshold temperature amounts, the controller 122 goes on to determine if the humidity level is at the setpoint humidity level or in other words below the second threshold humidity level, as indicated by block 240. For example, a user may have selected 74° F. as the setpoint temperature and a humidity level of 40%. If the feedback from the temperature sensor is 77° F., the detected humidity level is 40%, and the first and second threshold temperature amounts are greater than 2° F. above the setpoint temperature level, the controller 122 recognizes that the enclosed space 132 should be cooled but that it does not need to be dehumidified. In response, the controller 122 activates a fifth mode of operation in which the first or second vapor compression loops 124 and 126 cools the supply airstream, as indicated by block 242. In other words, the controller 122 shuts down one of the vapor compression loops 124 or 126 while still operating the other. This enables the HVAC system 120 to gradually cool the enclosed space 132 using one of the vapor compression loops 124, 126.

While only certain features and embodiments of the present disclosure have been illustrated and described, many modifications and changes may occur to those skilled in the art, such as variations in sizes, dimensions, structures, shapes and proportions of the various elements, and values of parameters, such as temperatures, pressures, mounting arrangements, use of materials, colors, orientations, and so forth, without materially departing from the novel teachings and advantages of the subject matter recited in the claims. The order or sequence of any process or method steps may be varied or re-sequenced according to alternative embodiments. It is, therefore, to be understood that the appended claims are intended to cover all such modifications and changes as fall within the true spirit of the present disclosure. Furthermore, in an effort to provide a concise description of the exemplary embodiments, all features of an actual implementation may not have been described, such as those unrelated to the presently contemplated best mode of carrying out the present disclosure, or those unrelated to enabling the claimed subject matter. It should be appreciated that in the development of any such actual implementation, as in any engineering or design project, numerous implementation specific decisions may be made. Such a development effort might be complex and time consuming, but would nevertheless be a routine undertaking of design, fabrication, and manufacture for those of ordinary skill having the benefit of this disclosure, without undue experimentation.

The invention claimed is:

1. A vapor compression system, comprising a controller having a first mode of operation and a second mode of operation, wherein the controller is configured in the first mode of operation to activate a first compressor and a second compressor in response to a temperature level and a humidity level exceeding a threshold temperature and a threshold humidity level, respectively, and the controller is configured in the second mode of operation to activate only the first compressor in response to the humidity level exceeding the threshold humidity level.

2. The system of claim 1, wherein the controller is configured to control a valve to control a flow of a refrigerant to a reheat coil of the vapor compression system coupled to the first compressor.

3. The system of claim 2, wherein the valve comprises a solenoid valve.

4. The system of claim 2, wherein the controller is configured to actuate the valve to block the flow of the refrigerant to the reheat coil in a third mode of operation, and wherein the controller is configured to switch to the third mode of operation in response to the temperature level exceeding a second threshold temperature.

5. The system of claim 2, wherein the controller is configured to actuate the valve to block the flow of the refrigerant to the reheat coil in a third mode of operation, and wherein the controller is configured to switch to the third mode of operation in response to the temperature level exceeding a second threshold temperature and the humidity level being less than the threshold humidity level.

6. The system of claim 1, comprising the first compressor and the second compressor.

7. The system of claim 1, comprising a humidity sensor and a temperature sensor configured to detect the respective humidity level and the temperature level.

8. A vapor compression system, comprising:

a first vapor compression loop comprising a first compressor, a first evaporator coil, and a reheat coil fluidly coupled to the first evaporator coil;

a second vapor compression loop comprising a second compressor and a second evaporator coil;

a temperature sensor configured to detect a temperature in an enclosed space and to transmit a first signal indicative of the temperature;

a humidity sensor configured to detect a humidity level in the enclosed space and to transmit a second signal indicative of the humidity level; and a controller coupled to the first compressor, the second compressor, the temperature sensor, and the humidity sensor, wherein the controller comprises a first mode of operation and a second mode of operation, and wherein the controller is configured in the first mode of operation to activate the first compressor and the second compressor in response to the temperature and the humidity level exceeding a threshold temperature amount and a threshold humidity level, respectively, and wherein the controller is configured in the second mode of operation to activate the first compressor and not the second compressor in response to only the humidity level exceeding the threshold humidity level.

9. The system of claim 8, comprising a valve configured to control a flow of a refrigerant to the reheat coil.

10. The system of claim 9, wherein the valve comprises a solenoid valve.

11. The system of claim 9, wherein the controller is configured to actuate the valve to block the flow of the refrigerant to the reheat coil in a third mode of operation, and wherein the controller switches to the third mode of operation in response to the temperature exceeding a second threshold temperature.

12. The system of claim 9, wherein the controller is configured to actuate the valve to block the flow of the refrigerant to the reheat coil in a third mode of operation, and wherein the controller is configured to switch to the third mode of operation in response to the temperature exceeding a second threshold temperature and the humidity level being less than the threshold humidity level.

13. The system of claim 8, wherein the second vapor compression loop comprises a second reheat coil.

14. The system of claim 8, wherein the controller is configured to alternate between activating the first compressor and the second compressor in the second mode of operation each time the humidity level exceeds the threshold humidity level.

15. A method of controlling a vapor compression system, comprising:

receiving a first signal from a temperature sensor indicative of a temperature in an enclosed space;

receiving a second signal from a humidity sensor indicative of a humidity level in the enclosed space;

comparing the temperature to a threshold temperature amount;

comparing the humidity level to a threshold humidity level;

activating a first mode in response to the temperature exceeding a threshold temperature amount, wherein a first compressor and a second compressor of the vapor compression system are activated; and activating a second mode in response to the humidity level exceeding the threshold humidity level and not the temperature exceeding the threshold temperature amount such that only the first compressor is activated.

16. The method of claim 15, comprising a first valve configured to control a flow of a refrigerant to a first reheat coil coupled to the first compressor.

17. The method of claim 16, wherein the first valve comprises a solenoid valve.

18. The method of claim 16, comprising activating a third mode of operation of the vapor compression system wherein the third mode of operation comprises actuating the first valve to block the flow of the refrigerant to the first reheat coil, and wherein a controller is configured to activate the third mode of operation in response to the temperature exceeding a second threshold temperature.

19. The method of claim 16, comprising activating a third mode of operation of the vapor compression system wherein the third mode of operation comprises actuating the first valve to block the flow of the refrigerant to the first reheat coil in a third mode of operation, and wherein a controller is configured to switch to the third mode of operation in response to the temperature exceeding a second threshold temperature and the humidity level being less than the threshold humidity level.

20. The method of claim 16, comprising a second valve configured to control the flow of the refrigerant to a second reheat coil coupled to the second compressor.

21. The method of claim 20, wherein the second valve comprises a solenoid valve.

22. The method of claim 20, comprising activating a third mode of operation of the vapor compression system, wherein the third mode of operation comprises actuating the first valve or the second valve to block the flow of the refrigerant to the first reheat coil or the second reheat coil, respectively, and wherein a controller is configured to activate the third mode of operation in response to the temperature exceeding a second threshold temperature.

23. The method of claim 20, comprising activating a third mode of operation of the vapor compression system wherein the third mode of operation comprises actuating the first valve or the second valve to block the flow of the refrigerant to the first reheat coil or the second reheat coil, respectively, in a third mode of operation, and wherein a controller is configured to switch to the third mode of operation in response to the temperature exceeding a second threshold temperature and the humidity level being less than the threshold humidity level.

* * * * *